US005309878A

United States Patent [19]

Kandler et al.

[11] Patent Number: 5,309,878

[45] Date of Patent: May 10, 1994

[54] PULSED PRESSURE LUBRICATION SYSTEM FOR AN OVERHEAD VALVE ENGINE

[75] Inventors: William C. Kandler, New Holstein; John C. Whitton, Kiel, both of Wis.

[73] Assignee: Tecumseh Products Company, Tecumseh, Mich.

[21] Appl. No.: 34,293

[22] Filed: Mar. 22, 1993

[51] Int. Cl.[5] ..... F01M 1/06

[52] U.S. Cl. ..... 123/196 M; 123/90.34

[58] Field of Search ..... 123/196 M, 196 W, 90.34

[56] References Cited

U.S. PATENT DOCUMENTS

| | | | |
|---|---|---|---|
| 2,366,701 | 1/1945 | Doman | 123/90 |
| 2,572,968 | 10/1951 | Bachle | 123/90 |
| 2,865,361 | 12/1958 | Leach | 123/196 |
| 3,628,513 | 12/1971 | Grosseau | 123/90.34 |
| 4,258,673 | 3/1981 | Stoody, Jr. et al. | 123/90.34 |
| 4,343,270 | 8/1982 | Kawabe | 123/196 V |
| 4,601,267 | 7/1986 | Kronich | 123/90.33 |
| 4,662,328 | 5/1987 | Kronich | 123/198 C |
| 4,840,149 | 6/1989 | Fujita | 123/90.34 |
| 4,881,496 | 11/1989 | Kronich | 123/90.33 |
| 4,881,497 | 11/1989 | Matayoshi et al. | 123/90.34 |
| 4,896,634 | 1/1990 | Kronich | 123/90.34 |
| 4,926,814 | 5/1990 | Bonde | 123/196 W |
| 4,969,434 | 11/1990 | Nakagawa | 123/196 M |
| 4,974,561 | 12/1990 | Murasaki | 123/90.31 |
| 5,090,375 | 2/1992 | Hudson | 123/196 W |
| 5,195,472 | 3/1993 | Jacques | 123/90.33 |

*Primary Examiner*—Noah P. Kamen
*Assistant Examiner*—Erick Solis
*Attorney, Agent, or Firm*—Baker & Daniels

[57] ABSTRACT

An internal combustion engine including a camshaft journalled in a bearing for rotational movement therein. The camshaft includes a main oil passageway extending axially therethrough and is in flow communication with the oil sump. The camshaft further includes an auxiliary passageway extending from the main passageway to a sidewall outer surface of the camshaft. A first lubricating passageway is formed within the crankcase and extends from the camshaft bearing to the cylinder head, and a second lubricating passageway is formed within the cylinder head and extends from the first passageway to the upper portion of the valve rocker mechanism of the engine. As the camshaft rotates upon engine operation, the auxiliary passageway in the camshaft is in periodic flow communication with the first passageway to provide a pulsed flow of oil to the first passageway. The oil then flows through the second passageway and lubricates the valve rocker mechanism. A return oil passageway extends from the lower portion of the rocker box through the cylinder head and crankcase into the interior of the crankcase, wherein the oil falls back into the sump.

11 Claims, 1 Drawing Sheet

PULSED PRESSURE LUBRICATION SYSTEM FOR AN OVERHEAD VALVE ENGINE

BACKGROUND OF THE INVENTION

The present invention relates generally to lubrication systems for engines, and more particularly, to a lubrication system for the upper valve mechanism of an overhead valve engine.

Horizontal crankshaft engines generally include breather induced upper valve mechanism lubrication systems, wherein the breather is located on top of the rocker box, and where an oil mist is induced to flow upwardly by the breather from the crankcase through both push rod tubes to the rocker box chamber to lubricate the valve actuating mechanism in the rocker box. Oil which condenses in the rocker box is then drained back downwardly along the side walls of the push rod tubes to the crankcase.

In vertical crankshaft engines, the above-described breather induced lubrication system does not perform satisfactorily due to several problems. First of all, when the engine is oriented in the head down attitude, oil will not drain from the rocker box to the oil sump, thus causing oil to build up in the rocker box. As enough oil builds up, the breather will pump oil from the rocker box to the exterior of the engine. However, this is unsatisfactory because of oil spillage on and around the engine and the loss of lubricating oil which can result in engine failure due to lack of lubrication.

It has been proposed to use a scavenging pump to remove the liquid oil from the rocker box and thereby prevent the build up of liquid oil therein. However, the provision of such a pump adds to the cost of the engine which is unsatisfactory.

More recently, a lubrication system has been developed, wherein the breather is remote from the rocker box, and the system utilizes crankcase breather induction of oil mist in a counter flow through two separate push rod tubes with the feeder push rod tube directly connected to the engine crankcase and the return push rod tube connected to the engine breather box which vents through a breather mechanism to the atmosphere. This lubrication system causes oil mist from the crankcase to flow up one push rod tube, circulate within the cylinder head rocker box to lubricate the valve mechanism, and then be induced by the crankcase breather into the breather box where a liquid oil is separated from the vapors. The liquid oil drains back into the crankcase, and the vapors are vented to the atmosphere through the remote breather mechanism. Such a system is shown in U.S. Pat. No. 4,601,267.

Another recently developed lubrication system provides lubrication to the upper valve mechanism without requiring the use of breather induction. This system employs a centrifugal oil slinger in the crankcase, which slings oil through a push rod cavity that is in communication with the crankcase at one end and in communication with the rocker box at the other end. The rocker arms in the rocker box are disposed one above the other, each oriented for rocking in a substantially horizontal plane. A dam is provided for restraining oil slung into the rocker box at a level such that the lower rocker arm is partially submerged in a pool of liquid oil. The turbulence of the lower rocker arm and valve spring generates enough turbulence in the accumulated pool to cause splash lubrication onto the upper rocker arm and its associated valve assembly. Such a lubrication system is shown in U.S. Pat. No. 4,881,496.

SUMMARY OF THE INVENTION

The present invention provides a lubrication system for an internal combustion engine in which an oil lubricating passageway extends from the oil sump upwardly through the crankcase and then through the upper portion of the cylinder head and opens into the upper portion of the valve rocker mechanism for lubricating the valve rocker mechanism.

Generally, the invention provides, in one form thereof, an engine having a camshaft journalled in a bearing for rotational movement therein. The camshaft includes a main oil passageway extending axially therethrough which is in flow communication with the oil sump. This main oil passageway supplies oil to various lubrication spots in the engine, e.g., cylinder camshaft bearing, flywheel main bearing, connecting rod crankshaft bearing, and cylinder counterbalance shaft bearings. The camshaft further includes an auxiliary oil passageway that extends from the main passageway to a sidewall outer surface of the camshaft. A lubricating passageway is formed within the crankcase and cylinder head and extends from the camshaft bearing to the upper portion of the rocker box, which houses the valve rocker mechanism. As the camshaft rotates, the auxiliary oil passageway is in periodic flow communication with the lubricating passageway to provide a pulsed flow of lubricating oil through the lubricating passageway and into the upper portion of the rocker box to lubricate the valve rocker mechanism.

More specifically, the invention provides, in one form thereof, the lubricating passageway being in the form of two separate passages, the first passage being a drilled passage from the upper cylinder camshaft bearing to the cylinder head gasket, and the second passage being a drilled passage in the cylinder head extending from the head gasket to the upper portion of the rocker box. In addition, a return oil passageway is provided and extends from the lower portion of the rocker box through the cylinder head and crankcase into the interior of the crankcase, wherein the oil returns to the sump.

An advantage of the present invention is that the upper valve train lubrication system is completely independent from the engine breather system, and is thus unaffected by the breather system.

Another advantage of the present invention is that the upper valve train is lubricated by a pulsated flow of oil rather than a continuous flow of oil.

Yet another advantage of the present invention is that the upper valve train is lubricated by oil flowing from the top of the rocker box, and not by oil being splashed thereupon from the bottom of the rocker box.

Still another advantage of the present invention is that the valve train lubrication system is branched off the main lubricating system to provide a pressurized flow of lubrication oil to the valve train.

DETAILED DESCRIPTION OF THE INVENTION

Figure 1:
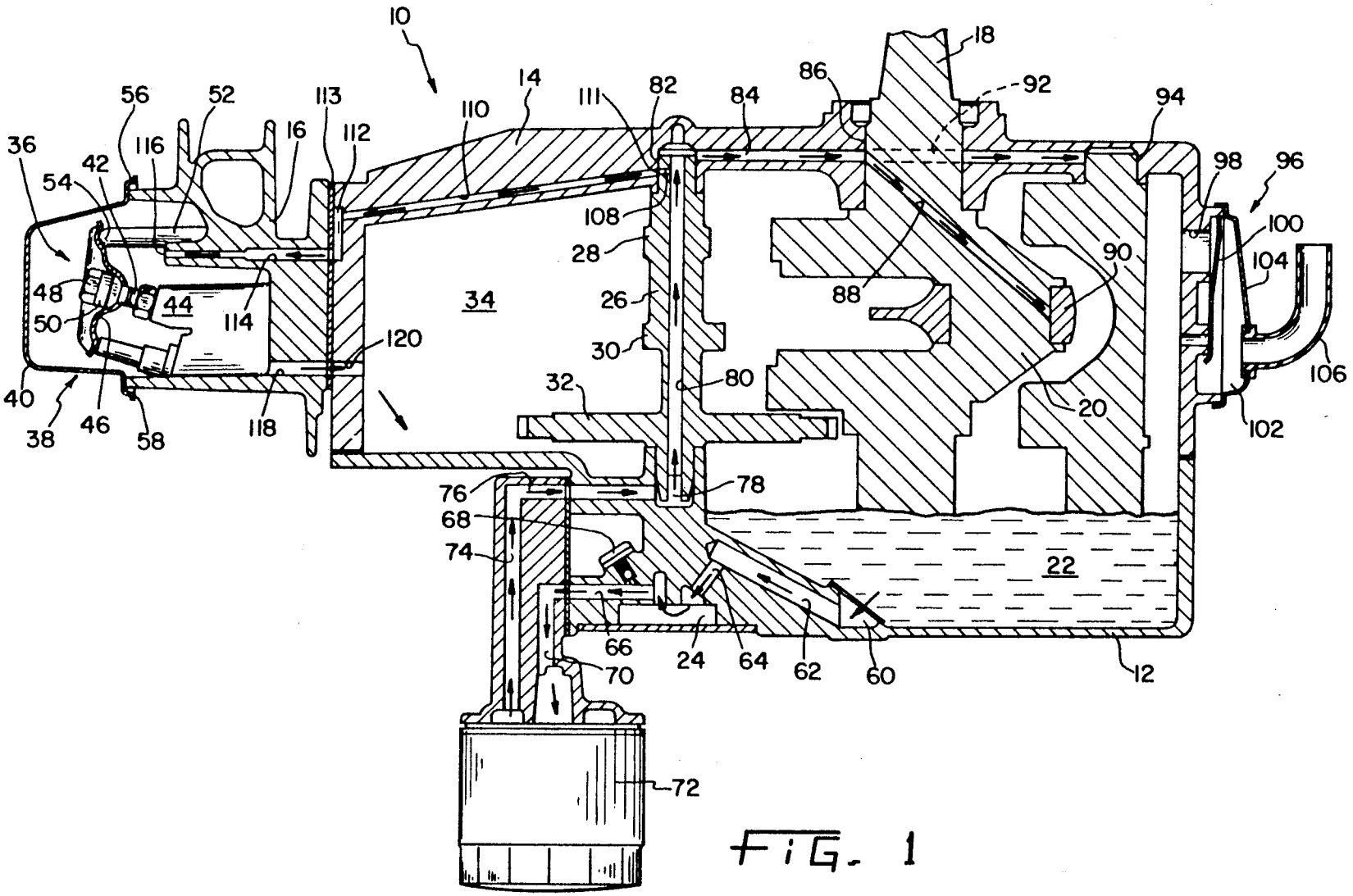
FIG. 1 is a partial sectional view of an overhead valve internal combustion engine that incorporates a rocker mechanism lubricating apparatus in accordance with the principles of the present invention.

Referring to FIG. 1, there is shown an air-cooled overhead valve internal combustion engine 10 comprising a crankcase 12 with an integral cylinder portion 14 and a cylinder head 16. Crankcase 12 includes a vertical output shaft 18 rotatably journalled therein and connected to a conventional vertical crankshaft. Shaft 18 includes an offset portion 20 which, via a connecting rod (not shown) is joined to a piston (not shown) mounted for reciprocal movement in a cylinder (not shown) formed in cylinder assembly 14. The reciprocal motion of the piston is translated into rotary motion of output shaft 18 due to the interconnection of the piston with the offset shaft portion 20 by the connecting rod.

An oil sump 22 serves as the main oil reservoir for the oil lubricating system of the engine and is circulated throughout the engine by an oil pump 24, which preferably comprises a rotary positive displacement pump. However, it should be understood that other types of pumps, such as piston type may be used.

A vertical camshaft 26 is journalled within crankcase 12 and includes an upper cam 28 and a lower cam 30. Camshaft 26 is driven by a cam gear 32 connected at the lower end of camshaft 26. Cam gear 32 is itself driven by a gear train (not shown) connected to the crankshaft in suitable fashion for proper valve timing. Cylinder portion 14 includes an integral cast cavity 34 housing a pair of push rods (not shown).

A rocker valve mechanism 36 is housed in a rocker box 38 disposed at the top of cylinder head 16. A seal 58 is provided between the rocker box and cylinder head so that cover 40 of rocker box 38 is sealingly engaged with cylinder head 16 so that no oil mist escapes from rocker box 38 external of the engine. Two threaded shafts 42 (only one shown) are received in threaded apertures in cast bosses 44 of cylinder head 16. Rockers 46 are retained on shafts 42 by means of nuts 48 whereby rockers 46 can rock or pivot in response to actuation of push rod 52 by tappets (not shown). Therefore, as push rods 52 are actuated by the tappets, the actuating ends 54 of push rods 52 will operate on rockers 46 to cause rockers 46 to pivot and thereby actuate the valve stems (not shown) of the valves (not shown).

The main oil lubricating system of the present invention includes an oil inlet 60 in the form of an opening in the sump wall. Oil is communicated into oil pump 24 via inlet passages 62 and 64. After drawing oil in from sump 22, pump 24 pumps oil into an outlet passage 66, which includes a pressure relief valve assembly 68 therein, and into a vertical passage 70 that leads to an oil filter element 72. The filtered oil is then forced vertically upwardly through passage 74, through horizontal passage 76, and then into opening 78 at the lower end of camshaft 26. Oil is forced under pressure through main oil passageway 80 of camshaft 26 and through an opening in the top of camshaft 26 for lubricating cylinder camshaft bearing 82. The oil is then communicated to horizontal passageway 84 for lubrication of the cylinder main bearing 86.

At bearing 86, lubrication passage 84 branches off into two separate passageways, passageway 88 that extends through the offset portion 20 of shaft 18 and terminates at connecting rod crankshaft bearing 90. The other branched passageway 92 extends through shaft 18 and through crankcase 12 to lubricate cylinder counterbalance shaft bearing 94.

A breather assembly 96 is secured to the vertical wall of crankcase 12 over an opening 98 in crankcase 12 defining a breather chamber. Breather chamber 98 is vented to the atmosphere through a reed valve 100. More specifically, valve 100 vents excess crankcase gases into a chamber 102 formed by breather housing 104. The gases are then communicated through a vent tube 106 that is secured to housing 104. The gases may then be vented to an air cleaner or to the atmosphere.

In an exemplary embodiment of the present invention, a portion of the lubricating oil flowing through main oil passageway 80 in camshaft 26 is delivered to a sidewall surface of camshaft 26 via an auxiliary passageway 108 formed in camshaft 26 and in communication with passageway 80. Preferably, auxiliary passageway 108 is formed near the upper cylinder bearing end of the camshaft and is generally perpendicular to passageway 80.

Auxiliary passageway 108 is in periodic flow communication with a lubricating passageway formed within engine 10 and extending from bearing 82 to the upper portion of rocker box 38. In particular, a first passageway is formed in crankcase 12 and comprises a first passage 110 formed in cylinder portion 14 of crankcase 12. The inlet end of passage 110 is an opening 111 in cylinder camshaft bearing 82. Opening ill is aligned with auxiliary passageway 108 such that as passageway rotates past opening ill, the two are in momentary flow communication so that oil is communicated from passageway 108 into opening 111. Passage 110 extends through cylinder portion 14 and into a second passage or groove 112 integrally formed in cylinder portion 14 adjacent head gasket 113. Groove 112 preferably extends vertically along head gasket 113.

A second passageway 114 is formed in the upper portion of cylinder head 16 and extends generally horizontally from its inlet at head gasket 113 to its outlet 116 within the upper portion of rocker box 38. Although the embodiment disclosed in FIG. 1 discloses the first passageway as comprising two passages 110 and 112, it will be appreciated that the geometry of the engine may be modified if desired to eliminate passage 112. For example, cavity 34 may be reduced at its upper end so that passage 110 could be drilled through cylinder portion 14 at an angle sufficient to align passage 110 directly to passage 114 at head gasket 113.

An oil return passageway is provided at the lower portion of rocker box 38 and comprises a first passage 118 formed within the lower portion of cylinder head and extending from rocker box 38 to head gasket 113. In addition, a second passage 120, collinear with passage 118, is formed in cylinder portion 14 of crankcase 12 and has an inlet opening in communication with passage 118 at head gasket 113. Passage 120 extends through cylinder portion 14 and has an outlet opening into cavity 34.

During engine operation, oil is pumped up through main passageway 80, wherein a portion of the oil flows through auxiliary passageway 108. As passageway 108 moves into momentary communication with passage 110, oil is admitted into opening 111, whereupon it flows through passage 110, groove 112, passageway 114 and out opening 116 to lubricate rocker mechanism 36. Oil flow through opening 116 is pulsed due to the intermittent feeding of oil into passage 110 because of the rotation of camshaft 26. After the oil falls downwardly over rocker mechanism 36 and onto the bottom of rocker box 38, it flows out of rocker box 38 via passages 114 and 120. The oil that exits passage 120 falls into cavity 34 and then into sump 22 for recirculation.

It will be appreciated that the foregoing is presented by way of illustration only, and not by way of any limitation, and that various alternatives and modifications may be made to the illustrated embodiment without departing from the spirit and scope of the invention.

What is claimed is:

1. An internal combustion engine comprising:

a crankcase having an oil sump therein;

a cylinder head secured to said crankcase;

a camshaft disposed in said crankcase and being journalled in a bearing in said crankcase for rotational movement therein, said camshaft including a main oil passageway extending axially therethrough and being in flow communication with said oil sump, said camshaft further including an auxiliary oil passageway therein extending from said main oil passageway to a sidewall outer surface of said camshaft disposed in said bearing;

an oil pump for delivering oil under pressure from said oil sump to said auxiliary oil passageway via said main oil passageway;

an intake valve and an exhaust valve;

a valve rocker mechanism disposed on said cylinder head and being operatively connected to said intake and exhaust valves;

a rocker box housing said valve actuating mechanism;

a lubricating passageway extending from said camshaft bearing to an upper portion of said rocker box and being aligned with said auxiliary oil passageway in said camshaft such that said lubricating passageway is in momentary flow communication with said auxiliary oil passageway upon each rotation of said camshaft to provide a pulsed flow of oil through said lubricating passageway and into said rocker box to lubricate said valve rocker mechanism; and a return passageway extending from a lower portion of said rocker box to the interior of said crankcase for returning the oil from the rocker box to said sump.

2. The engine of claim 1, wherein said auxiliary passageway is generally perpendicular to said main passageway.

3. The engine of claim 1, wherein said lubricating passageway comprises a first passageway formed in a cylinder portion of said crankcase, and a second passageway in flow communication with said first passageway and formed in said cylinder head and opening into said rocker box.

4. The engine of claim 3, wherein said first passageway includes a drilled passage extending from said camshaft bearing to a gasket disposed between said crankcase and said cylinder head, said first passageway further including an integral groove in said crankcase adjacent said gasket.

5. The engine of claim 4, wherein said groove is generally perpendicular to said second passageway.

6. The engine of claim 1, wherein said return passageway comprises a first passageway formed in said cylinder head and a second passageway formed in a cylinder head portion of said crankcase and inflow communication with said first passageway.

7. The engine of claim 6, wherein said first and second passageways are generally collinear.

8. The engine of claim 1, wherein said camshaft is disposed vertically in said crankcase, and said auxiliary oil passageway is formed in an upper bearing end of said camshaft.

9. An internal combustion engine comprising:

a crankcase having an oil sump therein;

a cylinder head secured to said crankcase;

a camshaft disposed in said crankcase and being journalled in a bearing in said crankcase for rotational movement therein, said camshaft including main oil lubricating passage means extending axially therethrough in flow communication with said oil sump and further including auxiliary lubricating passage means extending from said main passage means to a sidewall outer surface of said camshaft disposed in said bearing;

an oil pump for delivering oil under pressure from said oil sump to said main lubricating passage means;

an intake valve and an exhaust valve;

a valve rocker mechanism disposed on said cylinder head and being operatively connected to said intake and exhaust valves;

a rocker box housing said valve rocker mechanism;

secondary lubricating passage means extending from said camshaft bearing to an upper portion of said rocker box and being aligned with said auxiliary passage means such that said secondary lubricating passage means is in momentary flow communication with said auxiliary passage means upon each rotation of said camshaft to provide a pulsed flow of oil through said secondary lubricating passage means and into said rocker box to lubricate said valve rocker mechanism; and a return oil passage means extending from a lower portion of said rocker box to the interior of said crankcase for returning the oil from the rocker box to said sump.

10. A lubrication system for a valve rocker mechanism of an overhead valve internal combustion engine comprising:

a crankcase having an oil sump therein;

a cylinder head secured to said crankcase, wherein said valve rocker mechanism is disposed on said cylinder head and housed within a rocker box;

a valve rocker lubricating passageway formed in said crankcase and said cylinder head and extending from said sump into an upper portion of said rocker box, wherein a portion of said oil lubricating passageway is periodically obstructed during engine operation;

an oil pump for delivering oil under pressure from said oil sump through said lubricating passageway and into said upper portion of said rocker box, wherein the oil falls onto said valve rocker mechanism in a pulsed fashion; and an oil return passageway extending from a lower portion of said rocker box to the interior of said crankcase for delivering oil from said rocker box to said sump.

11. The lubrication system of claim 10, further comprising:

a camshaft disposed in said crankcase and being journalled in a bearing in said crankcase for rotational movement therein;

a camshaft passageway extending axially through said camshaft and being in flow communication with said oil sump;

an auxiliary oil passageway extending from said camshaft passageway to a sidewall outer surface of said camshaft disposed in said bearing;

a lubricating passageway extending from said camshaft bearing to said upper portion of said rocker box and being aligned with said auxiliary oil passageway in said camshaft such that said lubricating passageway is in momentary flow communication with said auxiliary oil passageway upon each rotation of said camshaft to provide a pulsed flow of oil through said lubricating passageway and into said rocker box to lubricate said valve rocker mechanism.

* * * * *